US011339666B2

(12) United States Patent
Hart et al.

(10) Patent No.: US 11,339,666 B2
(45) Date of Patent: May 24, 2022

(54) AIRFOIL WITH CAVITY DAMPING

(71) Applicant: General Electric Company, Schenectady, NY (US)

(72) Inventors: Andrew Clifford Hart, Greenville, SC (US); John McConnell Delvaux, Fountain Inn, SC (US); Joseph Anthony Weber, Simpsonville, SC (US); James Zhang, Simpsonville, SC (US); Peter de Diego, Zirconia, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/851,629

(22) Filed: Apr. 17, 2020

(65) Prior Publication Data

US 2021/0324743 A1 Oct. 21, 2021

(51) Int. Cl.

| | |
|---|---|
| ***F01D 5/16*** | (2006.01) |
| ***F01D 5/26*** | (2006.01) |
| *F01D 5/14* | (2006.01) |

(52) U.S. Cl.

CPC ..... *F01D 5/16* (2013.01); *F01D 5/26* (2013.01); *F01D 5/147* (2013.01);

(Continued)

(58) Field of Classification Search

CPC ... F01D 5/10; F01D 5/147; F01D 5/16; F01D 5/18; F01D 5/188; F01D 5/189; F01D 5/22; F01D 5/225; F01D 5/26; F01D 25/04; F01D 25/06; F05D 2230/60; F05D 2250/185; F05D 2260/96; F05D 2260/201; F05D 2260/2212; F05D 2260/36; F05D 2260/37; F05D 2260/902

See application file for complete search history.

(56) References Cited

U.S. PATENT DOCUMENTS 3,973,874 A * 8/1976 Corsmeier ..... F01D 5/189 416/97 A 4,171,184 A 10/1979 Lings et al.

(Continued)

FOREIGN PATENT DOCUMENTS

DE 102008059836 A1 6/2010

EP 0806545 A1 11/1997

(Continued)

OTHER PUBLICATIONS

European Search Report issued in connection with corresponding EP Application No. 21155098.3, dated Aug. 3, 2021, 9 pages.

(Continued)

*Primary Examiner* — Eldon T Brockman
*Assistant Examiner* — Danielle M. Christensen
(74) *Attorney, Agent, or Firm* — Charlotte Wilson; Hoffman Warnick LLC

(57) ABSTRACT

An article, such as a turbine blade, includes an airfoil. The airfoil includes a body, the body having an elongated internal cavity extending from a tip of the body. The cavity is defined an internal wall within the body. At least one elongated damping element is disposed in the elongated internal cavity and frictionally engages the internal wall. Thus, the least one elongated damping element is capable of damping vibrations in the article.

18 Claims, 9 Drawing Sheets

(52) U.S. Cl.
CPC .... *F05D 2230/60* (2013.01); *F05D 2240/304* (2013.01); *F05D 2240/307* (2013.01); *F05D 2250/185* (2013.01); *F05D 2260/201* (2013.01); *F05D 2260/202* (2013.01); *F05D 2260/96* (2013.01)

(56) References Cited

U.S. PATENT DOCUMENTS

| | | | | |
|---|---|---|---|---|
| 4,484,859 | A | 11/1984 | Pask et al. | |
| 6,341,941 | B1 * | 1/2002 | Namura | F01D 5/225 416/190 |
| 7,955,054 | B2 | 6/2011 | El-Aini et al. | |
| 8,579,593 | B2 * | 11/2013 | Campbell | F01D 5/16 416/229 A |
| 2010/0329847 | A1 | 12/2010 | Yamashita et al. | |
| 2016/0222796 | A1 * | 8/2016 | Spangler | F01D 5/187 |
| 2018/0328187 | A1 * | 11/2018 | Oke | F01D 9/065 |
| 2018/0328188 | A1 | 11/2018 | Marinelli et al. | |
| 2020/0149402 | A1 * | 5/2020 | Propheter-Hinckley | F01D 5/141 |

FOREIGN PATENT DOCUMENTS

| | | | |
|---|---|---|---|
| EP | 2071128 | A2 | 6/2009 |
| EP | 3896256 | A1 | 10/2021 |
| WO | 2015042009 | A1 | 3/2015 |

OTHER PUBLICATIONS

Notice of Publication issued in connection with corresponding EP Application No. 21155098.3, dated Sep. 22, 2021, 2 pages.

* cited by examiner

AIRFOIL WITH CAVITY DAMPING

The invention was made under a U.S. Government contract DOE Contract Number DE-FE0031613 and the Government has rights herein.

BACKGROUND

The disclosure relates generally to a self-damping turbine blade. Further, the disclosure relates to the damping of blades used in turbines.

One concern in turbine operation is the tendency of the turbine blades to undergo vibrational stress during operation. In many installations, turbines are operated under conditions of frequent acceleration and deceleration. During acceleration or deceleration of the turbine, the blades are, momentarily at least, subjected to vibrational stresses at certain frequencies and in many cases to vibrational stresses at secondary or tertiary frequencies. When a blade is subjected to vibrational stress, its amplitude of vibration can readily build up to a point which may alter operations.

Turbine and compressor sections within an axial flow turbine engine generally include a rotor assembly comprising a rotating disk and a plurality of rotor blades circumferentially disposed around the disk. Each blade includes a root, an airfoil, and a platform positioned in the transition area between the root and the airfoil. The roots of the blades are received in complementary shaped recesses within the disk. The platforms of the blades extend laterally outward and collectively form a flow path for fluid passing through the rotor stage. The forward edge of each blade is generally referred to as the leading edge and the aft edge as the trailing edge. Forward is defined as being upstream of aft in the gas flow through the engine.

During operation, blades may be excited into vibration by a number of different forcing functions. Variations in gas temperature, pressure, and/or density, for example, can excite vibrations throughout the rotor assembly, especially within the blade airfoils. Gas exiting upstream of the turbine and/or compressor sections in a periodic, or "pulsating" manner can also excite undesirable vibrations.

Blades can be damped to avoid vibration. For example, it is known that dampers may be attached to an external surface of the airfoil. A recognized disadvantage of adding a frictional damper to an external surface is that the damper is exposed to the harsh, corrosive environment within the engine. As soon as the damper begins to corrode, its effectiveness may be compromised. In addition, the damper may separate from the airfoil because of corrosion.

BRIEF DESCRIPTION

A first aspect of the disclosure provides an article, such as a turbine blade. The blade comprises an airfoil. The airfoil comprises a body, the body having an elongated internal cavity extending from a tip of the body. The cavity comprises an internal wall within the body. At least one elongated damping element is disposed in the elongated internal cavity and frictionally engages internal wall. Thus, the least one elongated damping element is capable of damping vibrations in the article.

A further aspect of the disclosure provides an article, such as a turbine blade. The blade comprises an airfoil. The airfoil comprises a body, the body having an elongated internal cavity extending from a tip of the body. The cavity comprises an internal wall within the body. At least one elongated damping element is disposed in the elongated internal cavity and frictionally engages the internal wall. The at least one elongated damping element disposed in the elongated internal cavity comprises an impingement sleeve. The impingement sleeve comprises at least one contact point protrusion on each side of the impingement sleeve, each at least one contact point frictionally engaging internal walls of the cavity. Thus, the least one elongated damping element is capable of damping vibrations in the article.

Another aspect of the disclosure provides an article, such as a turbine blade. The blade comprises an airfoil. The airfoil comprises a body, the body having an elongated internal cavity extending from a tip of the body. The cavity comprises an internal wall within the body. At least one elongated damping element is disposed in the elongated internal cavity and frictionally engages the internal wall. The at least one elongated damping element comprises at least one elongated damping biasing element. The at least one elongated damping biasing element comprises a serpentine-like spring element that is friction fit in the cavity and contacts the internal wall of the cavity. Thus, the least one elongated damping element is capable of damping vibrations in the article.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
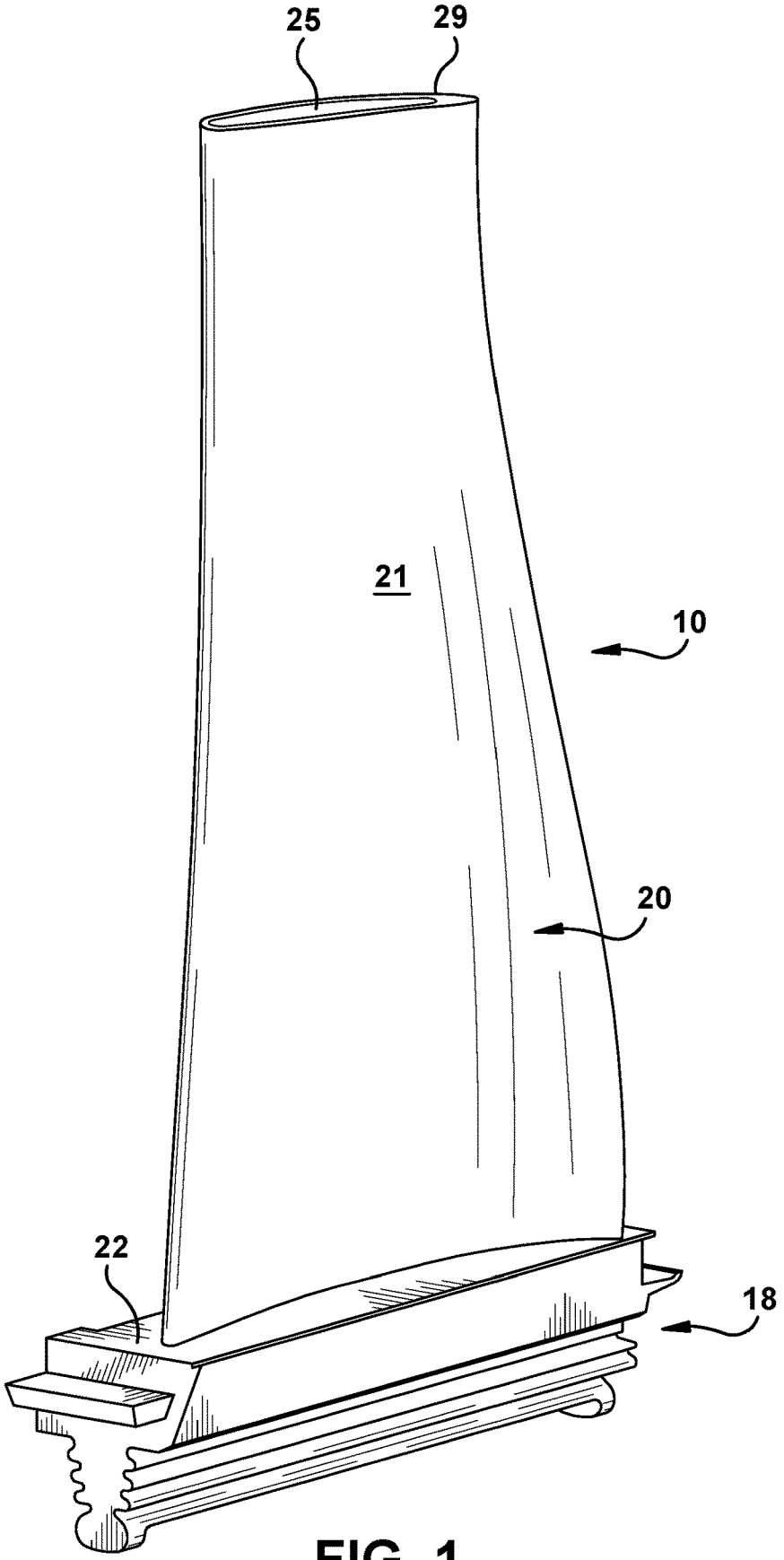
FIG. 1 is a side schematic perspective illustration of a blade in accordance with embodiments of this disclosure.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

As an initial matter, in order to clearly describe the current disclosure it will become necessary to select certain terminology when referring to and describing relevant machine components within a turbine system. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine system or, for example, the flow of air through the combustor or coolant through one of the turbine's component systems. The term "downstream" corresponds to the direction of flow of the fluid, and the term "upstream" refers to the direction opposite to the flow. It is recognized that in an opposed flow configuration, upstream and downstream directions may change depending on where one is in the turbine system. The terms "forward" and "aft," without any further specificity, refer to directions, with "forward" referring to the front end of the turbine system, and "aft" referring to the rearward of the turbine system. It is often required to describe parts that are at differing radial positions with regard to a center axis. The term "radial" refers to movement or position perpendicular to an axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine system, e.g., an axis of a rotor thereof.

In addition, several descriptive terms may be used regularly herein, as described below. The terms "first", "second", and "third" may be used interchangeably to distinguish one component from another and are not intended to signify location or importance of the individual components.

Referring to FIG. 1, a blade assembly (hereinafter blade) 10 for a turbine is illustrated. The blade 10 includes a root 18, an airfoil 20, an airfoil body 21, a tip 29, and a platform 22. The root 18 (often referred to as a dovetail or fir tree) includes a geometry that mates with that of one of the recesses within a disk (not illustrated for ease of illustration) of the turbine. The fir tree configuration is common and is used in this instance for illustrative purposes and not intended to limit the embodiments in any manner.

Figure 2:
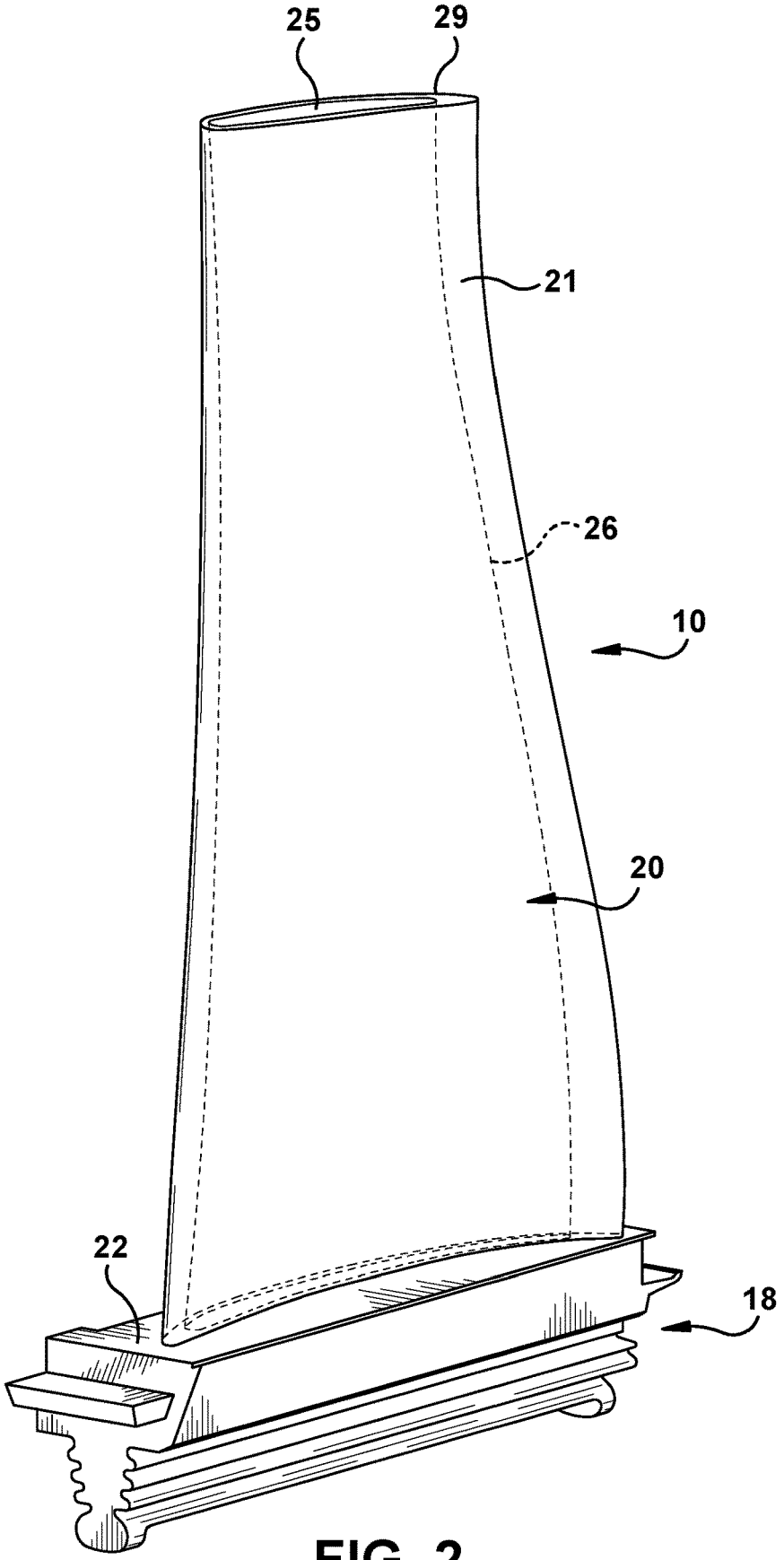
FIG. 2 is a side schematic perspective illustration of a blade and at least one damping element in accordance with embodiments of this disclosure.

In accordance with embodiments and with reference to the Figures, in FIG. 1, the tip 29 defines an opening 25 for an elongated internal cavity 26 (hereinafter "cavity" and illustrated in dashed lines in FIG. 2) that extends from tip 29 of the airfoil 20 to a length within the blade 10. This may be as short as a cavity only extending part of the span of the airfoil 20, or as tall as extending fully through the airfoil 20 and through the root 18. Further, cavity 26 is defined by internal walls 26' (FIG. 3) to present a shape that generally mirrors the peripheral geometry of the body 21 exterior of the airfoil 20. Alternatively, the cavity 26 may comprise a configuration that enables enhanced damping of the blade 10 when provided with at least one damping element, as discussed hereinafter.

While the Figures herein of the embodiments illustrate the tip 29 open, a cap (not illustrated) can be added on the tip 29 of the airfoil 20. The cap is capable of closing the cavity 26, after an impingement sleeve 30 is provided in the cavity, as described hereinafter.

Figure 3:
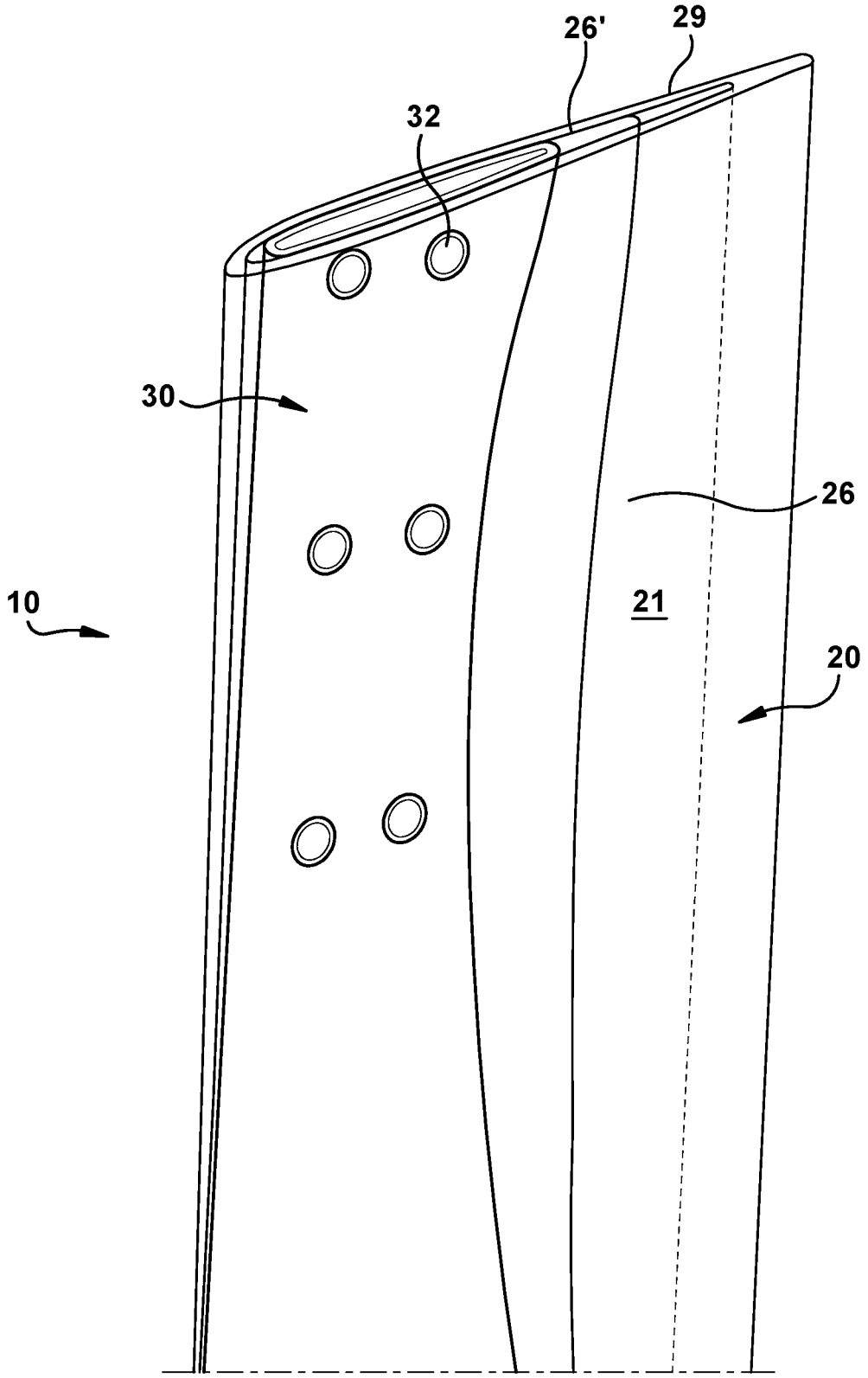
FIG. 3 is a side schematic perspective illustration of a partial blade and at least one damping element in the form of an impingement sleeve in accordance with embodiments of this disclosure.

FIG. 3 illustrates at least one damping element, which in the illustrated embodiment of FIG. 3 comprises an impingement sleeve 30. The impingement sleeve 30 is capable of being inserted into the cavity 26 of the airfoil where the airfoil 20 is illustrated in partial vertical length for ease of illustration purposes only. In FIG. 3, the impingement sleeve 30 comprises at least one retention member. In the embodiment of FIG. 3, the at least one retention member comprises at least one contact point protrusion 32 on each side of the impingement sleeve 30.

Figure 4:
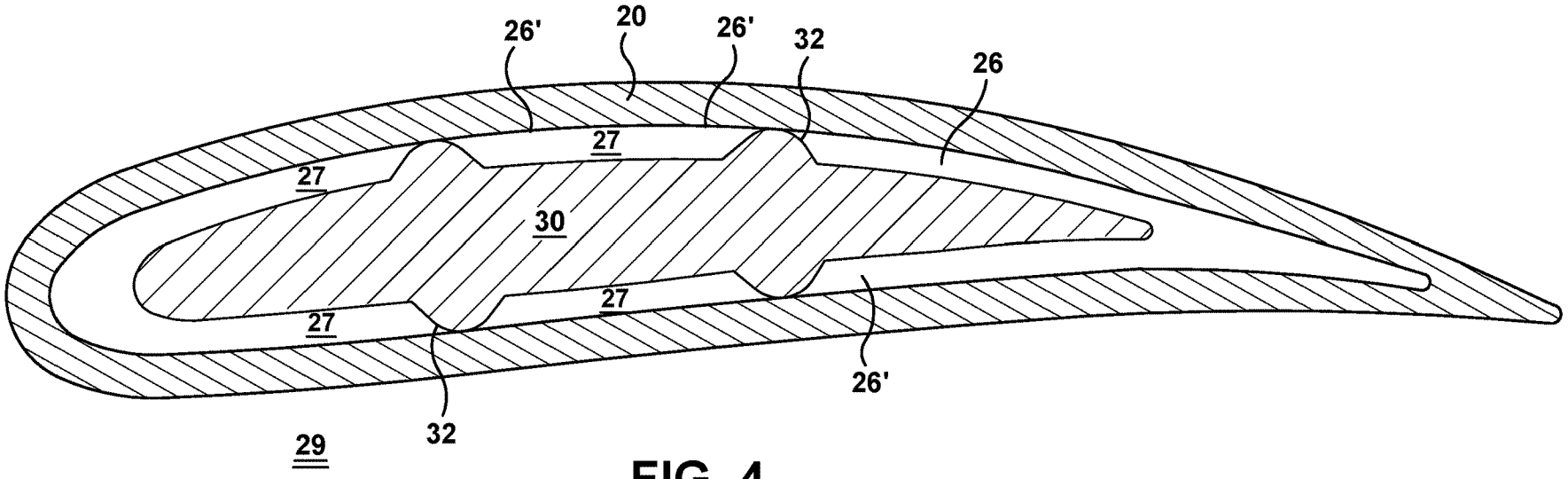
FIG. 4 is a top schematic cross-sectional illustration of a blade and at least one damping element in the form of an impingement sleeve in accordance with embodiments of this disclosure.

The at least one contact point protrusion 32 spaces the impingement sleeve 30 from the internal walls 26' of the cavity 26 to define a space 27 (see FIG. 4). The space 27 surrounds the impingement sleeve 30 and is encircled by the internal wall 26' of the cavity 26. Accordingly, the impingement sleeve 30 is thus positioned and is capable of permitting cooling fluid flow in the cavity 26 around each of the at least one contact point protrusion 32. Accordingly, the impingement sleeve 30 and the at least one contact point protrusion 32 reduces the overall size of the cavity 26. With such a reduced size, the amount of cooling fluid or cooling air is reduced for keeping the airfoil 20 at acceptable operational temperatures.

Figure 5:
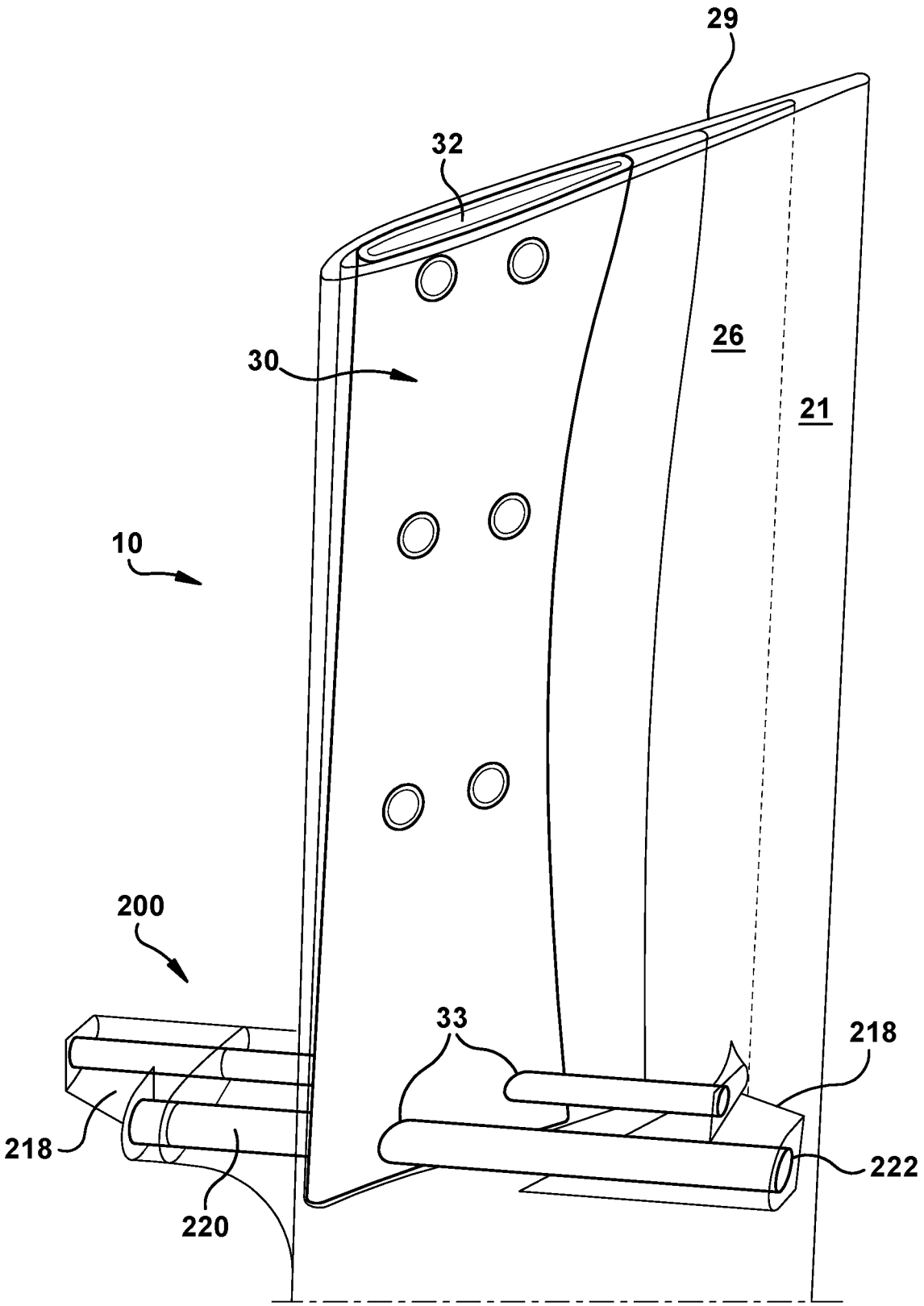
FIG. 5 is a side schematic perspective illustration of a partial blade and at least one damping element in the form of an impingement sleeve in accordance with certain embodiments of this disclosure.

The at least one contact point protrusion 32 is illustrated in FIGS. 3, 4 and 5, as well as other Figures, as essentially circular "dimples" on the impingement sleeve 30. This configuration is merely exemplary of possible configurations of the at least one contact point protrusion 32. The at least one contact point protrusion 32 can be formed in any configuration or shape which provides that the at least one contact point protrusion 32 engages the walls 26' of the cavity 26 in a frictional manner. Such shapes include, but are not limited to, at least one of conical, rectangular, triangular, pyramidal, and/or polygonal, as long as the at least one contact point protrusion 32 spaces the impingement sleeve 30 from the walls 26' of the cavity 26, provides frictional engagement therebetween, and damps vibration and relative movements of the airfoil 20.

Thus, the impingement sleeve 30 partially fills the cavity 26. The impingement sleeve 30 via its at least one contact point protrusion 32 engages side walls of the cavity, establishes a contact load therebetween, and maintains the impingement sleeve 30 away from the cavity's forward and rearward areas (at the leading and trailing regions of the airfoil 20). Thus, the impingement sleeve 30 and internal wall 26' of the cavity 26 at these forward and rearward areas (leading and trailing edges) are not in direct contact with the impingement sleeve 30 itself.

Further, embodiments provide that the impingement sleeve 30 extends and occupies as much of the cavity as possible. This spatial positioning of the impingement sleeve 30 in the cavity 26 to as much of an extent as possible, enables enhanced and extended damping, reduces the amount of cooling fluid or cooling air needed for the blade, and may also increase durability and life of the blade 10 and the associate turbomachinery.

The configuration and engagement of the at least one contact point protrusion 32 of the impingement sleeve 30 with the engagement of the internal walls 26' of the cavity 26 intrinsically and naturally define at least one retention structural member for the impingement sleeve 30 against the walls 26' of the cavity 26.

The at least one contact point protrusion 32 may also act as a turbulation element that provides turbulent mixing, swirling, and desirable flow characteristics to the cooling fluid or cooling air. The resultant flow can forcibly cool the airfoil 20 by the combination of the circulation cooling and turbulent flow, thus achieving an enhanced cooling effect with the same or even a reduced amount of cooling fluid or cooling air.

The frictional engagement of the at least one contact point protrusion 32 of the impingement sleeve 30 and the internal wall of the cavity 26 provides damping of the airfoil 20. The impingement sleeve 30 and frictional engagement reduce and may substantially eliminate vibration of the airfoil 20 during operation. That vibration of the airfoil 20 may result from the operational use, loads, vibrations and any stresses occurring during operation, as discussed above. Thus, with mitigated, reduced, and possibly substantial elimination of vibrations (in some contexts), the airfoil 20 should undergo less detrimental forces, stresses, and vibrations. These beneficial reductions of forces, stresses, and vibrations are capable of extending and enhancing the durability and life of an airfoil 20 and blade 10 provided with the damping, as per the embodiments.

Figure 6:
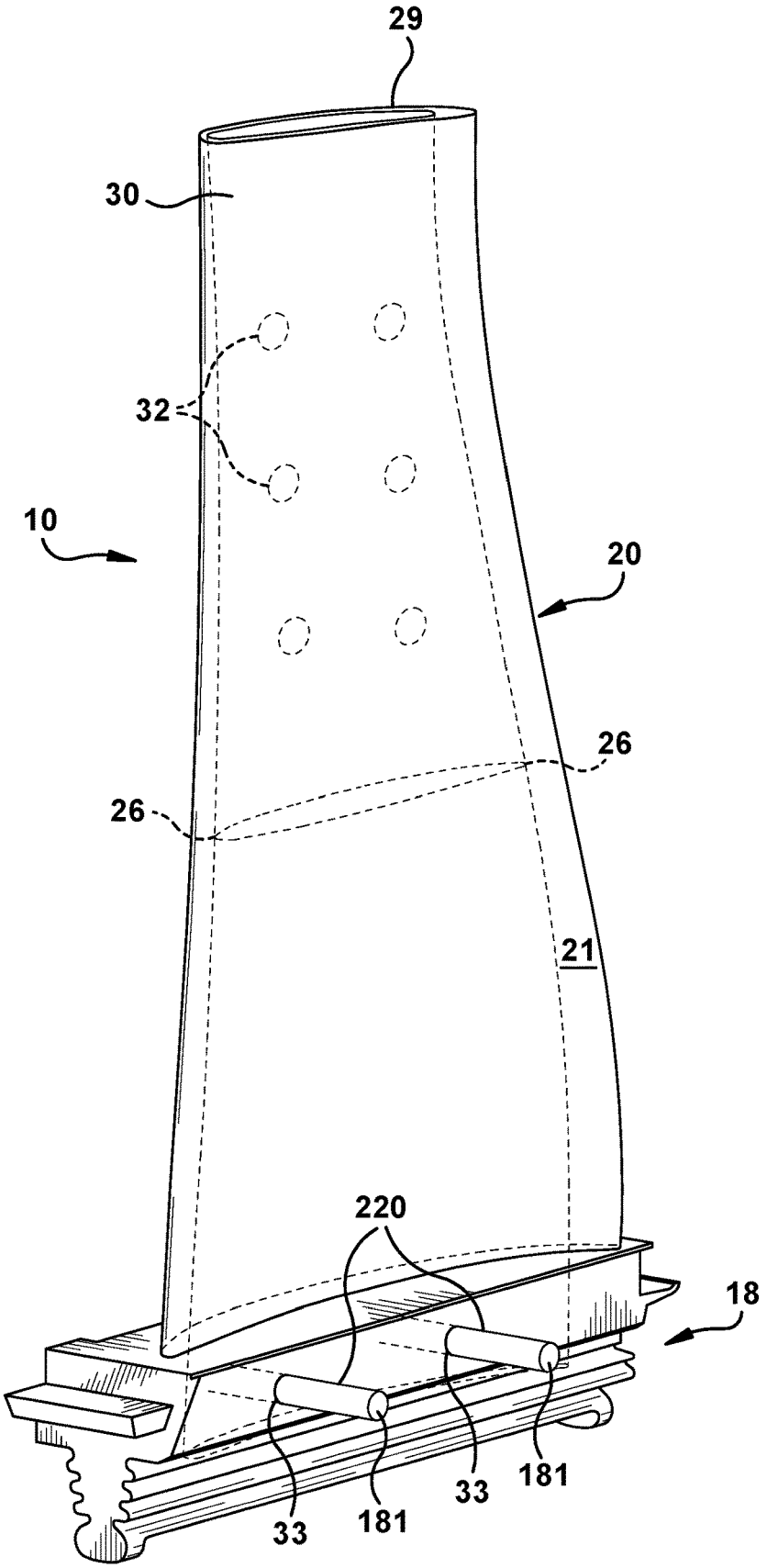
FIG. 6 is a further side schematic perspective illustration of a partial blade and at least one damping element in the form of an impingement sleeve in accordance with certain embodiments of this disclosure.

According to embodiments, the impingement sleeve 30 is inserted into the cavity 26. In some embodiments, the impingement sleeve 30 is inserted into the cavity 26 extending partially down the length of the body 21 and terminates before the platform 22 (FIG. 5). In other embodiments, the impingement sleeve 30 is inserted into the cavity 26 extending entirely down the length of the body 21 and terminates at the platform 22. And, in some further embodiments, the impingement sleeve 30 is inserted into the cavity 26 extending partially down the length of the body 21, extends past the platform 22 and enters the root 18 where it terminates in the root 18 (FIG. 6).

The impingement sleeve 30 and cavity 26 may extend into the body 20 of the blade 10 as far and as deep as feasible. The feasibility of the impingement sleeve 30 depth considers various factors such as but not limited to configuration, material, dimensions, and the like.

In larger blades 20, such as those in large turbines, the blade 10 may include a part shroud span 200 (FIG. 5) for, but not limited to, stability and operation purposes. The part-span shroud 200 is provided on the airfoil 20 and comprises a pair of part-span connectors 218 extending from the airfoil 20 at both the suction side and pressure side of the blade 20, respectively. Each of the pair of part-span shrouds 200 can be sized to complement and engage a corresponding part-span connector on an adjacent turbine blade 20.

As illustrated in FIG. 5, this embodiment provides the impingement sleeve 30 extending partially down the length of the body 21 and terminates at the part-span shroud 200 before the platform 22. In this embodiment, to secure the impingement sleeve 30 in the cavity 26 at the part-span shroud 200, at least one retention pin 220 is provided extending through at least one retention pin aperture 222 in the part-span shroud 200. The respective retention pin 220 may be sized to be aligned with the exterior surface of the body 20, here the part-span shroud 200, to provide an essentially co-planar and smooth surface.

The impingement sleeve 30 can comprise at least one impingement sleeve through hole 33. The at least one impingement sleeve through hole 33 is aligned with the at least one retention pin aperture 222. Accordingly, a retention pin 220 that is inserted into the at least one retention pin aperture 222 in the part-span shroud 200 will extend into and through the airfoil body 21, through and exit the at least one impingement sleeve through hole 33 in the impingement sleeve 30, and into the opposed at least one retention pin aperture 222 on the opposing side of the airfoil body 21 in the part-span shroud 200. Accordingly in operation, as the blade 10 rotates, the frictional contact of the impingement sleeve 30 via the at least one contact point protrusion 32 to the internal walls of the cavity 26 will hold the impingement sleeve 30 therein, with the at least one retention pin 220 and the at least one retention pin aperture 222 engagement with the part-span shroud 200 providing additional securing.

In embodiments where the impingement sleeve 30 extends down the length of the body 21 and by the platform 22 into the root 18, a similar configuration with retention pins 220 can be provide in the root 18. The respective retention pin 220 is again sized to be aligned with the exterior surface of the body 20, here the base 18, to provide an essentially co-planar and smooth surface. In this embodiment, to secure the impingement sleeve 30 in the cavity 26 at the base 18, the at least one retention pin 220 is provided extending through at least one retention pin aperture 181 in the base 18. Accordingly in operation of this embodiment, as the blade 10 rotates, the frictional contact of the impingement sleeve 30 via the at least one contact point protrusion 32 to the internal walls of the cavity 26 will hold the impingement sleeve 30 therein, with the at least one retention pin 220 engagement with the base 18 and at the at least one retention pin aperture 181 providing additional securing.

The impingement sleeve 30 can be formed from materials that are compatible with the material from which the blade 10 is formed. For example, the impingement sleeve 30 can include a superalloy, such as but not limited to GTD-444 (Trademark of General Electric Company) L605 (under-platform material for some blades), a CMC material (that can provide light weight and wear-tolerant properties), and other such materials. Moreover, if the impingement sleeve 30 material oxides to a certain extent, and the oxides have lubricous properties, the lubricous oxidation would advantageously further enable damping of the impingement sleeve 30 and the blade 10.

Figure 7:
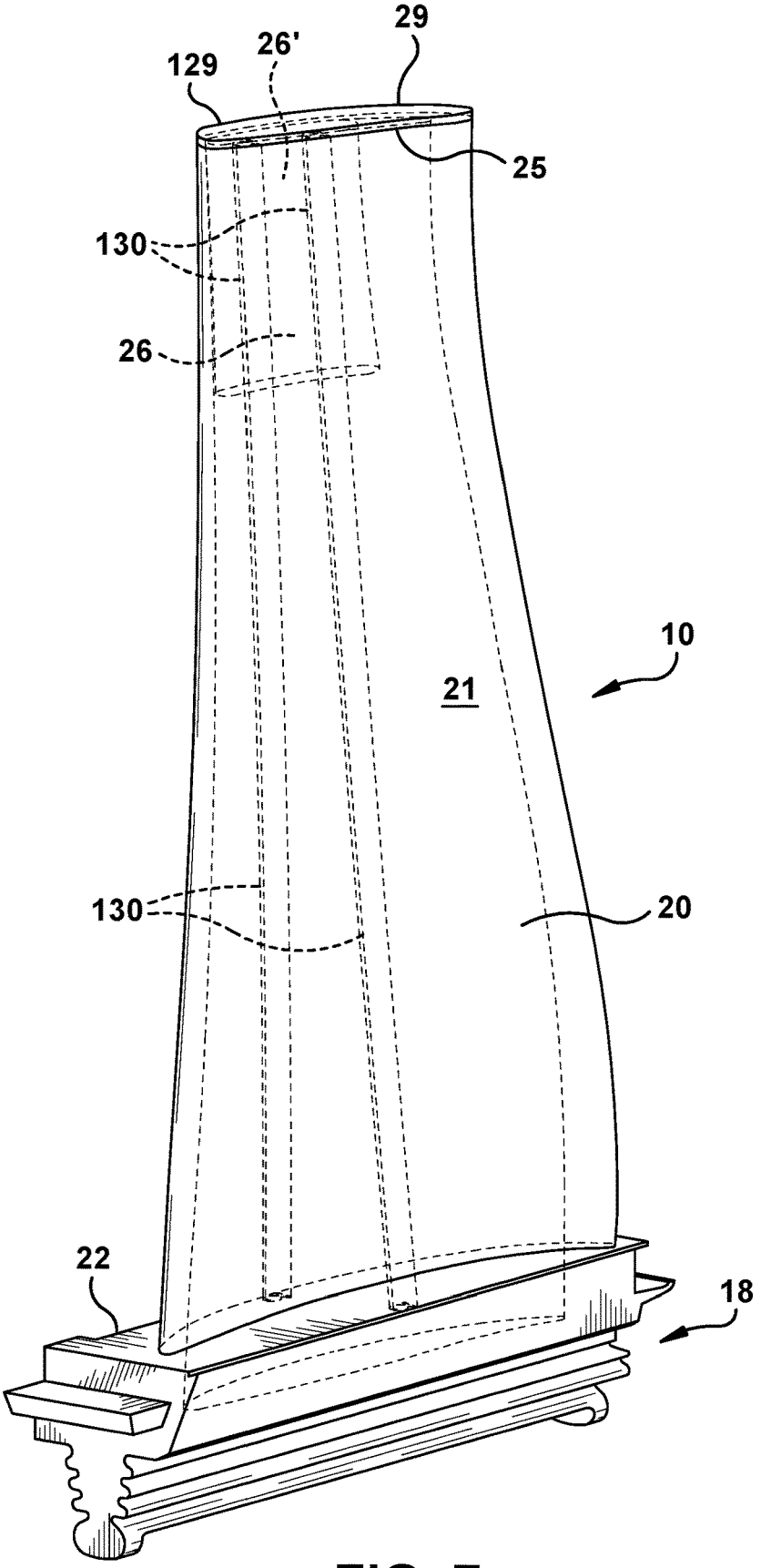
FIG. 7 is a side schematic perspective illustration of a blade and at least one damping element in the form of at least one damping biasing element in accordance with embodiments of this disclosure.

In another aspect of the embodiments, shown in FIG. 7, the cavity 26 of the blade 10 is provided with at least one damping biasing element 130. The at least one damping biasing element 130 comprises a serpentine-like spring element that contacts the internal walls 26' of the cavity 26. In FIG. 7, part of the body 21 is sectioned to (for perspective purposes only) illustrate two of the at least one damping biasing element 130 in the cavity 26. While two serpentine-like damping biasing elements 130 are illustrated in FIG. 7, embodiments and aspects of the disclosure include the at least one serpentine-like damping biasing element 130. Other embodiments and aspects of the disclosure may also include two or more serpentine-like damping biasing elements 130 in the recess. For ease of description and in no way limiting of the embodiments, the embodiments hereinafter are discussed with element 130 as "at least one damping biasing element 130."

Each of the at least one damping biasing element 130 extends from the tip 29 of the body 20 toward the base 18. As above, in some embodiments, the at least one damping biasing element 130 can be inserted into the cavity 26 extending partially down the length of the body 21 and terminate before the platform 22 (this aspect of the embodiments not illustrated). In other embodiments, the at least one damping biasing element 130 can be inserted into the cavity 26 extending entirely down the length of the body 21 and terminates at the platform 22. And, in some further embodiments, the at least one damping biasing element 130 can be inserted into the cavity 26, extend partially down the length of the body 21, past the platform 22 and enter the root 18, where it terminates in the root 18 (FIG. 7).

The at least one damping biasing element 130 may be described as a serpentine-like reverse bent end spring clip. While a conventional spring clip has its arm "open" ends extending outwardly to receive an element to be retained by the spring clip, the at least one damping biasing element 130 is a reverse bent end spring clip, as illustrated herein. Thus, the arm "open" ends 136 of the arms 135 extend in on itself. This configuration of the at least one damping biasing element 130 provides enhanced outwardly directed biasing force (see arrow A in FIGS. 8 and 9) and a k factor that enhances the force against the walls 26' as determined by Hooke's Law. Thus, the configuration of the at least one damping biasing element 130 and its spring forces (as discussed hereinafter) enable the at least one damping biasing element 130 to intrinsically and naturally define at least one retention structural member against the walls 26' of the cavity 26.

Figure 8:
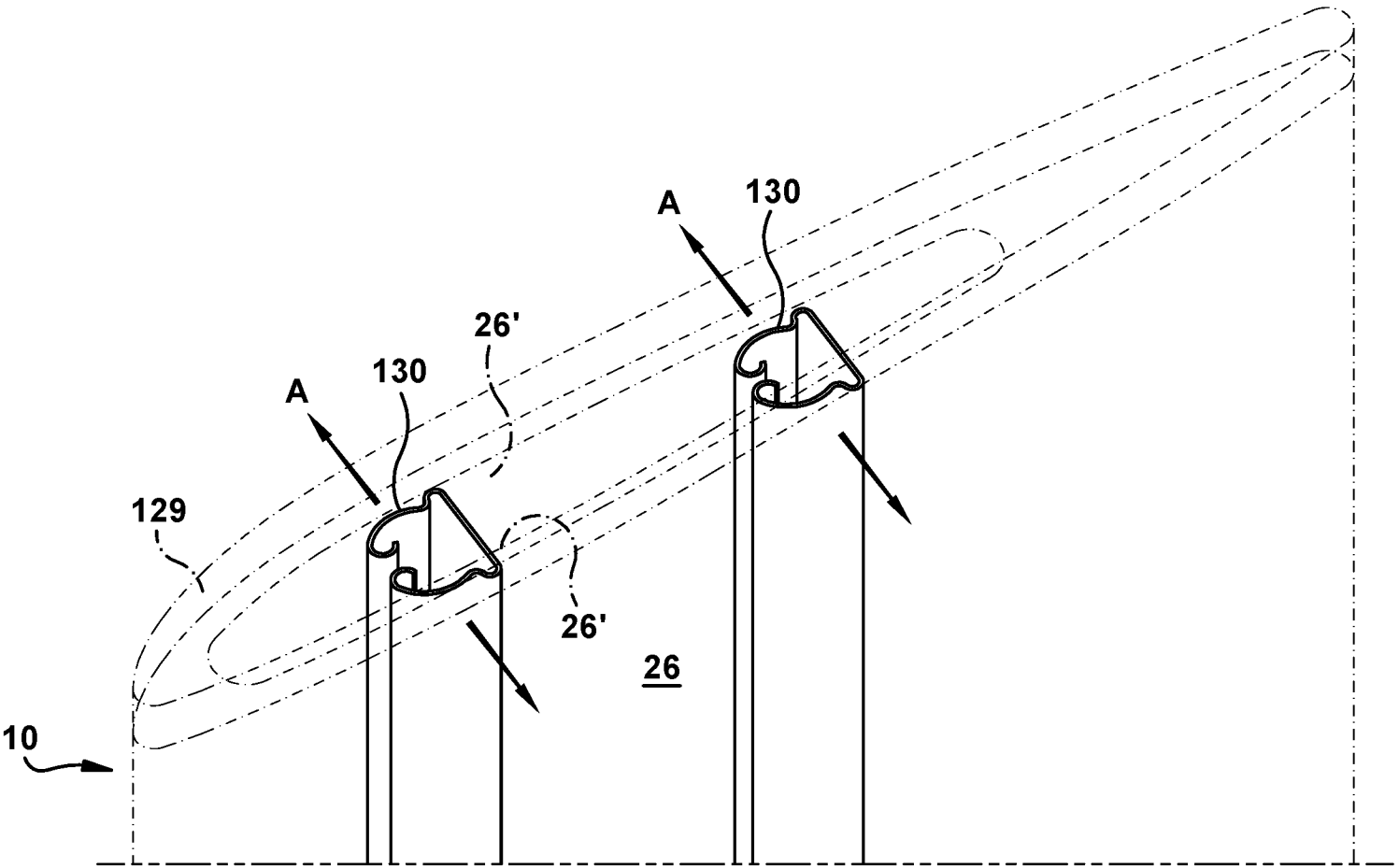
FIG. 8 is a partial side schematic perspective illustration of a blade and at least one damping element in the form of at least one damping biasing element in accordance with embodiments of this disclosure.

The at least one damping biasing element 130, as embodied by the disclosure, can be maintained in the recess 26 by its outwardly directed biasing force pushing against the walls 26' of the cavity 26. FIG. 8 illustrates the tip 29 of the blade 10 as embodied herein. The at least one damping biasing element 130 (illustrated in detail in FIG. 9), when in the cavity 26, is under compressive forces as it contacts walls 26'. Accordingly, the outwardly directed biasing force of the at least one damping biasing element 130 is capable of damping vibration, stresses, and the like during operation of the blade 10.

Figure 9:
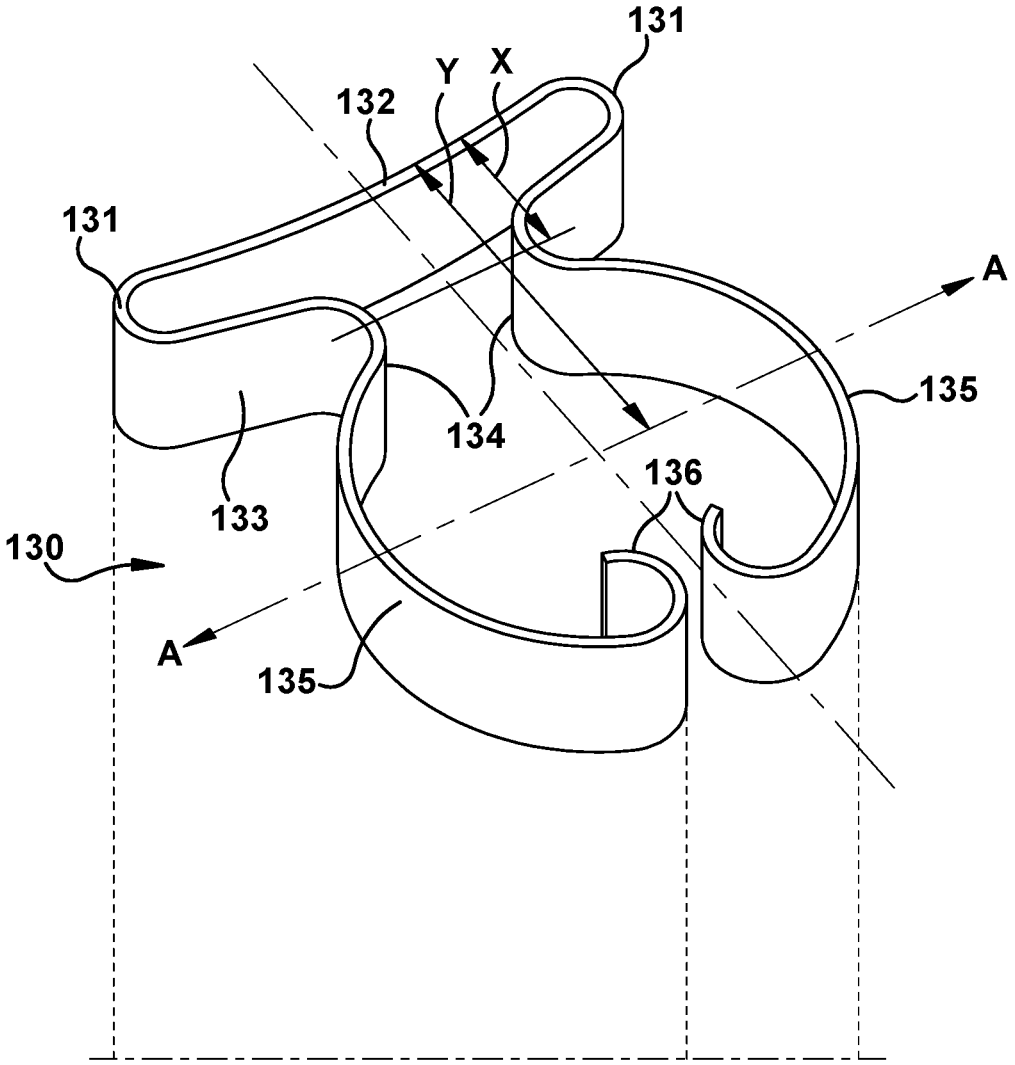
FIG. 9 is a perspective illustration of a damping biasing element in accordance with embodiments of this disclosure.

With reference to FIG. 9, the at least one damping biasing element 130 comprises a base 132 and base leg rounds 131. The base legs rounds 131 each define a bend so to create a return portion 133. Each return portion 133 extends inwardly toward a "mid-way portion" of the base 132 but extending away from the base a distance X. The return portion 133 that extends from each base leg 131 returns on itself to create an inner bend 134. From the inner bend 134, the at least one damping biasing element 130 extends outwardly or back out from the inner most extent of the inner bend 134 to define a set of arms 135. Arms 135 are opposedly concave to each other with their radii essentially aligned with the midpoint of the base 132 at a distance Y from the base 132. In essence as the arms begin to return towards each other, the arms form a circular area. The arm "open" ends 136 of the arms 135 of the at least one damping biasing element 130 are circled back towards the interior of the formed circular area.

The at least one damping biasing element 130 when positioned in the cavity makes contact with the walls 26' at the base rounded legs 131 and at the outermost points of the arms 135, all of which form the at least one retention structural member, as per the embodiments. Thus, each at least one damping biasing elements 130 make 4 points of contact with the internal walls 26'. The ends 136 of the arms are closer to each other when under compression in the cavity 26 (as in FIG. 8) than when compared to the uncompressed state outside of the cavity 26 (for example as in FIG. 9). This aspect of the embodiments is best illustrated in FIG. 8.

When more than one at least one damping biasing element 130 is provided in the cavity 26, each of the at least one damping biasing element 130 acts independent of each other. Also, when more than one at least one damping biasing element 130 is provided, the more than one at least one damping biasing element 130 may have a similar k factor. In other embodiments, when more than one at least one damping biasing element 130 is provided, each of the more than one at least one damping biasing element 130 may have different k factors providing gradients or differential damping characteristics to the blade 10.

The at least one damping biasing element 130 can be coupled or attached to one or more points in at least one of the airfoil 10 and the cavity 26. The coupling or attachment may be achieved by appropriate physical joinder system, including but not limited to mechanical joinder, metallurgical (welding or brazing) joinder, any adhesives, or the like known now or hereafter.

Moreover, as embodied herein, the at least one damping biasing element 130 can be maintained in the cavity 26 by coupling to a cap 129. The cap 129 is attached to the body 21 of the airfoil 20 at the tip 29. The cap 129, when attached to and closing the cavity 26, does not permit the at least one damping biasing element 130 to move out of the cavity 26. Also, the cap 129, as it is capable of contacting and end of the at least one damping biasing element 130 at the tip 29, may restrict movement of the at least one damping biasing element 130 in all directions, including but not limited to out of the cavity 26, e.g., by touching and restraining movement of the at least one damping biasing element 130.

Furthermore, noting the volume of the at least one damping biasing element 130 in the cavity as illustrated in FIGS. 7 and 8, the cavity 26 retains space therein both in and around the at least one damping biasing element 130. Thus, cooling fluid or cooling air that flows in the cavity 26 should not be encumbered by the at least one damping biasing element 130 in the cavity.

Each at least one damping biasing element 130 acts to stiffen the walls 26' of the body 20 of the blade 10. The stiffening occurs by expansive pressure from each at least one retention structural member of the at least one damping biasing element 130 against the internal walls 26' of the cavity 26. This pressure manages damping, stresses, vibrations and the like to which the blade may be subjected.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Where an element or layer is referred to as being "on," "engaged to," "disengaged from," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. An article, the article comprising:

an airfoil, including:

a body, the body having an elongated internal cavity extending from a tip of the body, the cavity defined by an internal wall within the body;

at least one elongated damping element, the at least one elongated damping element disposed in the elongated internal cavity and frictionally engaging the internal wall, thus being capable of damping vibrations, wherein the at least one elongated damping element includes at least one retention structural member, and the at least one elongated damping element being frictionally positioned in the elongated internal cavity by a friction fit of the at least one retention structural member against the internal wall of the cavity, and the at least one elongated damping element disposed in the elongated internal cavity includes an impingement sleeve, and wherein at least one retention member of the impingement sleeve includes at least one contact point protrusion on the impingement sleeve, the at least one contact point protrusion including a circular dimple, and each at least one contact point protrusion including the at least one retention structural member frictionally engaging the internal wall of the cavity.

2. The article of claim 1, wherein the at least one contact point protrusion on the impingement sleeve further comprises a plurality of contact point protrusions on the impingement sleeve.

3. The article of claim 1, wherein the airfoil includes a tip, a base, and a root, the base and root being at an opposite end of the airfoil from the tip, the cavity extends from the tip of the airfoil towards the base and the root, the at least one elongated damping element extends longitudinally from the tip toward the base and the root.

4. The article of claim 3, wherein the at least one elongated damping element extends longitudinally from the tip and ends at or below the base.

5. The article of claim 3, wherein the at least one elongated damping element extends longitudinally from the tip and extends into the root.

6. The article of claim 1, where each of the at least one elongated damping element permits cooling fluid flow in the cavity and around each of the at least one elongated damping element, whereby amounts of cooling fluid flow in the cavity of airfoil are reduced by the at least one damping element positioned in the cavity.

7. The article of claim 1, wherein the article includes a turbine blade in a turbine.

8. An article, the article comprising:

an airfoil, including:

a body, the body having an elongated internal cavity extending from a tip of the body, the cavity defined by an internal wall within the body;

at least one elongated damping element, the at least one elongated damping element disposed in the elongated internal cavity and frictionally engaging the internal wall, thus being capable of damping vibrations, wherein the at least one elongated damping element includes at least one retention structural member, and the at least one elongated damping element being frictionally positioned in the elongated internal cavity by a friction fit of the at least one retention structural member against the internal wall of the cavity, and wherein the airfoil comprises a tip and a base, the base being at an opposite end of the airfoil from the tip, the cavity extending from the tip of the airfoil towards the base, wherein the airfoil further comprises at least one part-span shroud on the body, the at least one part-span shroud positioned between the tip and the base of the airfoil, the at least one elongated damping element extending from the tip of the airfoil and ending in the cavity at the part-span shroud.

9. The article of claim 8, wherein the at least one part-span shroud further comprises at least one retention pin aperture, an impingement sleeve comprising at least one impingement sleeve through hole aligned with the at least one retention pin aperture, and wherein the article further comprises a retention pin configured for extending through the at least one retention pin aperture in the at least one part-span shroud and the at least one impingement sleeve through hole of the impingement sleeve for securing the at least one impingement sleeve to the part-span shroud of the airfoil.

10. The article of claim 8, wherein the at least one elongated damping element disposed in the elongated internal cavity includes an impingement sleeve.

11. The article of claim 10 wherein at least one retention member of the impingement sleeve includes at least one contact point protrusion on the impingement sleeve, each at least one contact point protrusion including the at least one retention structural member frictionally engaging the internal wall of the cavity.

12. The article of claim 11, wherein the at least one contact point protrusion on the impingement sleeve further comprises a plurality of contact point protrusions on the impingement sleeve.

13. The article of claim 8, wherein the airfoil includes a root, the base and root being at an opposite end of the airfoil from the tip, the cavity extends from the tip of the airfoil towards the base and the root, the at least one elongated damping element extends longitudinally from the tip toward the base and the root.

14. The article of claim 13, wherein the at least one elongated damping element extends longitudinally from the tip and ends at or below the base.

15. The article of claim 13, wherein the at least one elongated damping element extends longitudinally from the tip and extends into the root.

16. A turbine blade, the blade comprising:

an airfoil, including:

a body, the body having an elongated internal cavity extending from a tip of the body, the cavity defined by an internal wall within the body;

at least one elongated damping element, the at least one elongated damping element disposed in the elongated internal cavity and frictionally engaging the internal wall, wherein the at least one elongated damping element disposed in the elongated internal cavity includes an impingement sleeve, and wherein at least one retention member of the impingement sleeve includes at least one contact point protrusion on the impingement sleeve, the at least one contact point protrusion including a circular dimple, and each at least one contact point frictionally engaging an internal wall of the cavity, wherein the at least one elongated damping element includes at least one retention structural member, and the at least one elongated damping element being frictionally positioned in the elongated internal cavity by a friction fit of the at least one retention structural member against the internal wall of the cavity, and the at least one elongated damping element in the elongated internal cavity includes an impingement sleeve, and wherein at least one retention member of the impingement sleeve includes at least one contact point protrusion on the impingement sleeve, each at least one contact point protrusion including the at least one retention structural member frictionally engaging the internal wall of the cavity.

17. The turbine blade of claim 16, wherein the airfoil includes a tip and a base, the base being at an opposite end of the airfoil from the tip, the cavity extending from the tip of the airfoil towards the base, and wherein the airfoil further includes at least one part-span shroud on the body, the at least one part-span shroud positioned between the tip and the base of the airfoil, the at least one elongated damping element extending from the tip of the airfoil and ending in the cavity at the part-span shroud.

18. The turbine blade of claim 17, wherein the at least one part-span shroud further includes at least one retention pin aperture, the impingement sleeve comprising at least one impingement sleeve through hole aligned with the at least one retention pin aperture, and wherein the article further comprises a retention pin configured for extending through the at least one retention pin aperture in the at least one part-span shroud and the at least one impingement sleeve through hole of the impingement sleeve for securing the at least one impingement sleeve to the part-span shroud of the airfoil.

* * * * *